United States Patent [19]

Fottner

[11] Patent Number: 4,457,235

[45] Date of Patent: Jul. 3, 1984

[54] SWITCH FOR SUSPENDED TRACK APPARATUS

[75] Inventor: Franz Fottner, Hilgertshausen, Fed. Rep. of Germany

[73] Assignee: Veit Bekleidungs-Technik GmbH & co., Landsberg, Fed. Rep. of Germany

[21] Appl. No.: 331,313

[22] Filed: Dec. 16, 1981

[30] Foreign Application Priority Data

Dec. 22, 1980 [DE] Fed. Rep. of Germany ..... 3048384

[51] Int. Cl.[3] ..... E01B 25/26

[52] U.S. Cl. ..... 104/104; 104/130

[58] Field of Search ..... 104/93, 96, 104, 130, 104/103

[56] References Cited

U.S. PATENT DOCUMENTS

| | | | |
|---|---|---|---|
| 2,725,017 | 11/1955 | Bedford et al. | 104/104 |
| 2,944,491 | 7/1960 | Le Fiell | 104/130 X |
| 3,006,287 | 10/1961 | Schmidt, Jr. | 104/130 X |
| 4,016,818 | 4/1977 | Ellzey | 104/130 X |

FOREIGN PATENT DOCUMENTS 1940256 2/1971 Fed. Rep. of Germany .

*Primary Examiner*—Robert B. Reeves
*Assistant Examiner*—David F. Hubbuch
*Attorney, Agent, or Firm*—Kenyon & Kenyon

[57] ABSTRACT

Disclosed is a switch for a suspended track transport apparatus, particularly of the building-block type and especially for interior use in the apparel industry. The switch comprises a support structure which includes two support tubes connected together at an angle to each other and a cross-stiffening element connected between the two support tubes. Stationary track sections are supported by the support tubes. Movable track sections are movably supported by pivot bearings and are coupled to each other by a lever apparatus. A switch setting device determines the switch position. The lever apparatus and the pivot bearings are accommodated within a dead space having sides extending along the support tubes and the cross-stiffening element of a height not exceeding the distance from fixed track sections to the support tubes. The lever apparatus is engaged in the vicinity of the movable track sections and is held at one end in the pivot bearing.

14 Claims, 5 Drawing Figures

SWITCH FOR SUSPENDED TRACK APPARATUS

BACKGROUND OF THE INVENTION

The present invention relates to a switch for a suspended track transport apparatus, particularly for interior use.

Interior suspended track transport apparatus, particularly for use in the apparel industry, are known. See, for example, DE-OS No. 19 40 256. Such apparatus can use trollies having rollers disposed at an angle to each other to form a V which roll on V-shaped tracks. See, for example, U.S. Pat. No. 3,064,584 and said DE-OS No. 19 40 356. A building-block system concept is known which includes straight and curved track sections fastened to support tubes, and components such as switches, crossings and the like and provides installation and assembly flexibility as well as flexibility in modifying systems for particular interior spaces. It is further known to install track systems with ceiling suspension apparatus or by means of light-weight self-supporting floor stands.

Problems may arise with installing a switch in such prior art transport apparatus if, for example, the available space between the track and the ceiling is small, or if the ceiling suspension apparatus interferes with the movement of a switch lever mechanism used to make switch changes. In such cases, custom designs requiring custom installation constructions are necessary which introduce additional costs and installation time.

OBJECT AND SUMMARY OF THE INVENTION

It is an object of the present invention to provide a switch for a suspended track transport apparatus, particularly of the building block type, which avoids the difficulties of prior art switches described above and which can be installed even if the space between the track and ceiling approaches zero.

This and other objects are achieved, according to the invention, by constructing the switch so that it can be accomodated in a dead space within the support structure for the tracks. The dead space has sides extending along the support structure of a height not exceeding the distance from the support structure to the tracks. Lever means and pivot means for operating the switch are disposed within said dead space.

According to one aspect of the invention, the lever means and the pivot means are disposed so that the lever means engages the pivot means in the vicinity of the movable switch track sections.

The invention is based on the discovery by the applicants that a switch for a suspended track transport apparatus can be widely used if the lever means for operating the movable track sections requires no additional space beyond said dead space. According to the invention, the distance which a lever of the lever means must move to make a switch change is kept small, thereby linkage lengths from the lever to a switch setting device can be kept small so that the lever means can be accommodated in said dead space.

According to one embodiment of the invention, the perimeter of the dead space is defined by support tubes for the tracks and a transverse stiffening element. Thus, the dead space has sides extending along the support tubes and stiffening element of a height not exceeding the distance from the support tubes to the tracks and the distance from the transverse element to the tracks.

According to another aspect of the invention, a pivot means is provided which causes a movable track section to pivot about two axes in going from one switch position to the other. Thereby, the movable track sections follow a rotary and flipping path of motion in going from one switch position to another. Both of the pivoting axes extend transversely through the respective movable track section. The space required to accommodate the motion of the movable track sections is advantageously minimized in accordance with an aspect of the invention so that movement of the free ends of the switch track sections does not exceed the distance from the support tube sections to the tracks fastened thereto, thereby maintaining the free ends of the movable track sections within said distance.

According to another aspect of the invention, a pivot means for a curved movable track section is mounted to the transverse stiffening element, and the arc length of the curved track section and the length of a straight movable track section are chosen only slightly larger than the mutual distance between hooks of adjacently suspended trollies. This arrangement improves the stability of the curved track section of the switch substantially as compared to fastening the pivot means to one of the support tube sections.

According to another aspect of the invention, a curved movable track section is provided with an arc length which corresponds to $\frac{1}{8}$th of a circular arc. This arrangement has the advantage that a switch according to the invention can be employed either as a 90° or a 45° switch without changing the basic construction of the switch. In a 90° switch arrangement, two support tubes of the support structure are connected together to form a right angle with each other. In a 45° switch arrangement, two support tubes of the support structure are connected together to form an angle of 45° with each other. Both the 90° and 45° switch arrangements use the same basic switch construction and $\frac{1}{8}$th circular arc movable track section, the 90° switch arrangement utilizing another $\frac{1}{8}$th circular arc track switch which is, however, fixed.

Also two switches can be combined to form a composite three-way switch. The three-way switch includes three support tubes connected together at an angle with each other, a middle of the support tubes being disposed between the other two and being common to the two switches. For 90° switches, a T structure of the three support tubes is provided.

In many applications, the switch can advantageously be assembled into the track assembly to have a preferred or normal switch position. According to another aspect of the invention, the lever means is tensioned against the support structure by spring means which urge the switch into the normal switch position. Such spring means tensioned against the support structure provides a fine adjustment feature by making the point of engagement of the spring means at the lever means movable or selectable. Such adjustment improves performance particularly when the pivot means causes both a rotary and flipping motion of the movable track sections in going from one switch position to the other.

According to another aspect of the invention, two movable track sections of a switch are coupled together by an arrangement which includes a ball joint so as to provide for simultaneous movement of the two movable track sections.

According to another aspect of the invention, the switch operates semiautomatically, operating automatically in one direction. According to this aspect, the lever means is adapted to be actuated by a trolley, so as to cause the switch to change switch positions automatically in one direction.

The above and other objects, features, aspects and advantages of the invention will be more apparent from the following description of the preferred embodiments thereof when considered with the accompanying drawings and appended claims.

BRIEF DESCRIPTION OF THE DRAWINGS

The present invention is illustrated by way of example and not limitation in the figures of the accompanying drawings in which like numerals indicate similar parts and in which.

DESCRIPTION OF THE PREFERRED EMBODIMENTS

Referring more particularly now to the drawings, embodiments of switches according to the invention are illustrated.

Figure 1:
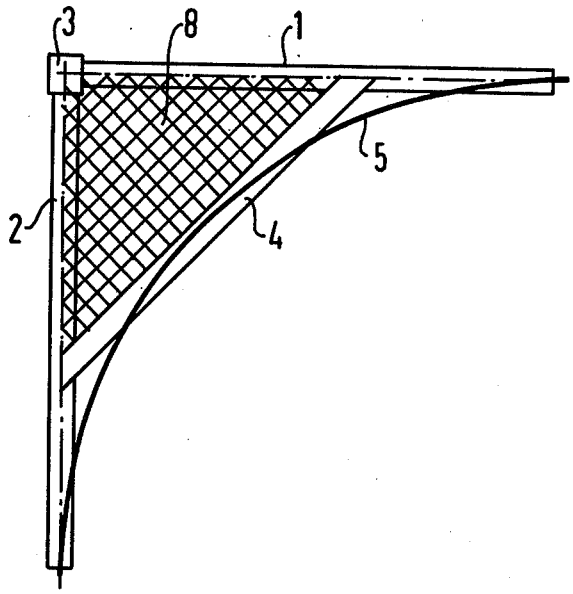
FIG. 1 is a schematic diagram of a top view of a switch according to the invention.

Referring to FIG. 1, a switch according to the invention comprises two support tubes 1 and 2 joined together to form a right angle with each other by a tube connecting piece 3 and braced by a transverse or cross brace 4, thereby forming a stable structural unit. The line 5 shown in FIG. 1 connected between the two free ends of the support tubes 1 and 2 and supported by the cross brace 4 represents a curved, at least partly movable track section. Generally, such a track section is provided as part of every switch and in conjunction with the switching mechanism, selectively enables a trolley (not shown) to travel without a change of direction in the axial direction of one of the two support tubes or to change its direction of travel from the axial direction of one of the two support tubes to the axial direction of the respective other of the two support tubes along the line 5.

Figure 2:
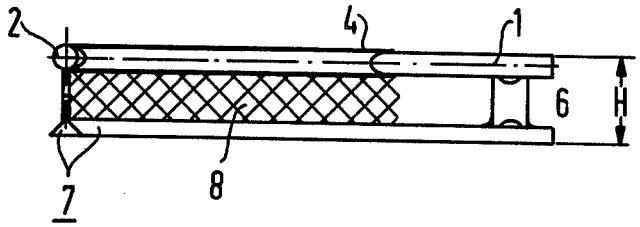
FIG. 2 is a schematic diagram of a side view of the switch of FIG. 1.

As shown in FIG 2, track sections 7 are fastened by spacers 6 to the underside off the support tubes 1 and 2. The trollies (not shown) have rollers which move along the tracks.

A dead space 8 of height H (within the combined height of the support tubes and tracks, i.e. the distance from the top of the support tubes to the bottom of the tracks) (FIG. 2) bounded by the two support tubes 1 and 2 and the cross brace 4 is shown hatched in FIG. 1. The dead space has sides which extend along the support tubes and brace of height H According to the invention, this dead space is utilized for accommodating the lever mechanism for operating the switch including the setting or actuating mechanism required to actuate the switch. The invention thereby makes wide use of the switch possible even under the most difficult installation and space conditions.

Figure 3:
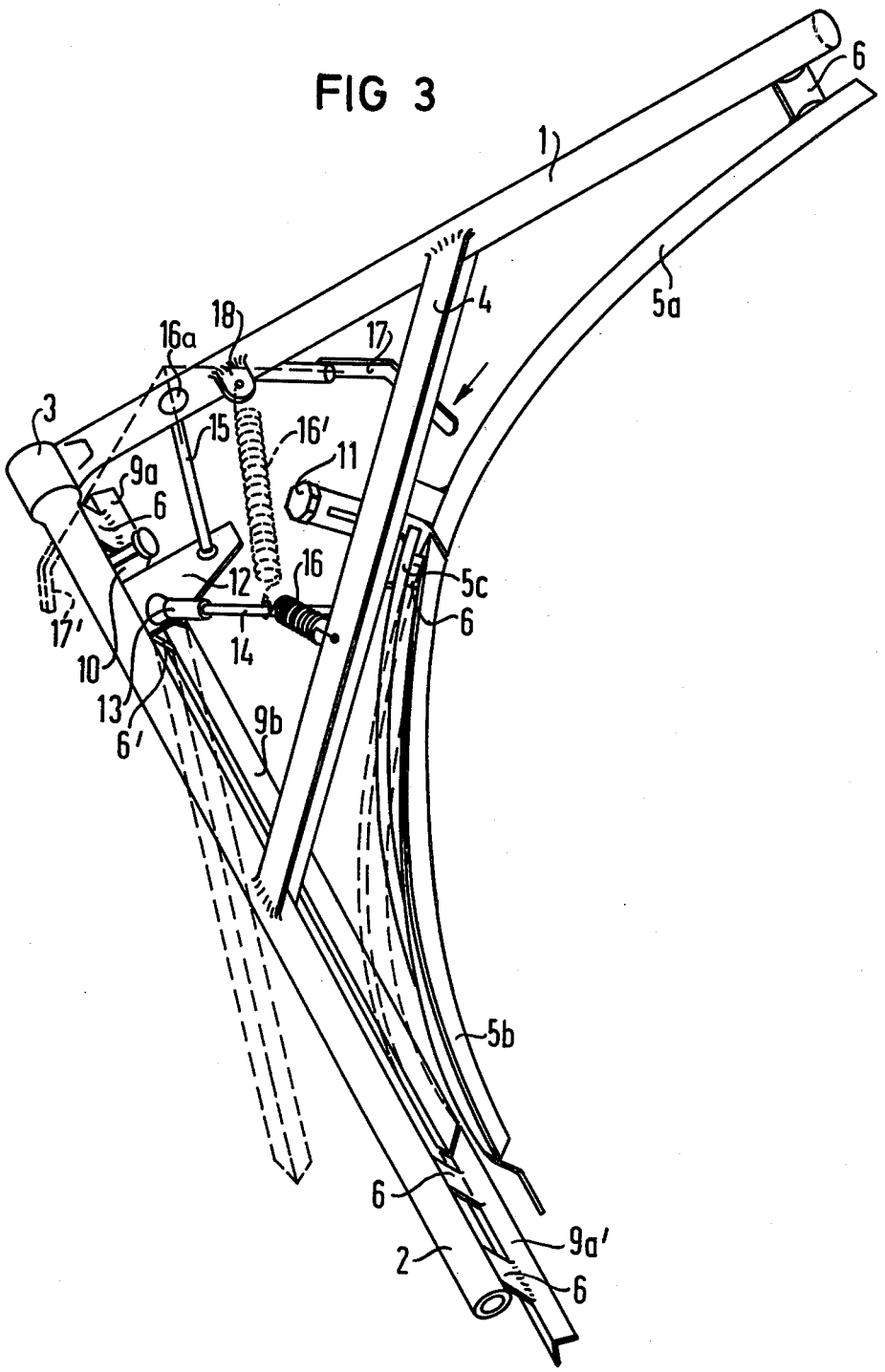
FIG. 3 is a perspective view showing a 90° switch according to the invention.

Referring now to FIG. 3, a semiautomatic switch is depicted which is operated automatically in one direction. The switch is operated automatically to enable a trolley from the axial direction of the support tube 1 which enters the curved fixed track section **5*a* to enter the movable track section 5*b*. The normal positions of the movable track sections, specifically the curved movable track section 5*b* and the straight movable track section 9*b*, are shown in FIG. 3 by solid lines while the switched position is shown by broken lines. In the normal position, the straight movable track section 9*b* is positioned below the support tube 2 aligned with the stationary straight track sections 9*a* and 9*a*' and the curved movable track section 5*b* is inwardly (with reference to the view of FIG. 3) offset and inclined relative to the fixed track section 9*a*'. The straight movable track 9*b* is secured at its far end (with reference to the view of FIG. 3) in pivot bearing 10 fastened to the support tube 2. The curved movable track section 5*b* is secured at its end adjacent to the curved track section 5*a* in pivot bearing 11 fastened to the cross brace 4**.

In the immediate vicinity of the pivot bearing 10, the straight movable track section **9*b* is connected by a spacer 6' to a lever plate 12. One end of a connecting rod 14 having a ball joint head 13 secured thereto engages the lever plate 12. The other end of the conecting rod 14 is rigidly fastened in the immediate vicinity of the pivot bearing 11 to a holding piece 5*c*, which in turn is connected by spacers 6 to the curved movable track section 5*b***.

The normal switch position, which, as mentioned, is shown in FIG. 3 by solid lines, is held in that position by a spring element, specifically a tension spring 16, engaged in tension between the connecting rod 14 and the cross brace 4. A bolt threaded into the connecting rod 14 (obscured by the tension spring 16) serves as a stop for the end hook of the tension spring 16 on the side thereof engaged with the connection rod 14. By turning the bolt, the point of engagement of the tension spring 16 with the connecting rod 14 can be adjusted within certain limits and can be used as a fine adjustment.

Still referring to FIG. 3, one end of a lever rod 15 is connected to the free end of the lever plate 12 and the other end of the rod is connected by a pivot bearing **16*a* to a setting lever 17 which is disposed at an angle with the lever rod 15. When a trolley enters the stationary curved track section 5*a*, the free end of the setting lever 17 is moved by the trolley in the direction of the arrow, thereby automatically switching the switch from its normal position to the switched position. During switching, the end of curved movable track section 5*b* adjacent to fixed track section 9*a*' is moved downwardly and inwardly (with reference to the view of FIG. 3) relative to the stationary straight track section 9*a*', while the straight movable track section 9*b* is moved outwardly (with reference to the view of FIG. 3) from the stationary straight track section 9*a*'** and upwardly at an angle thereto.

The automatic direction of operation of the switch can be reversed, if desired, by replacing spring 16 with spring 16' and lever 17 with lever 17'. Spring 16', shown by broken lines, can be fastened to the support tube section 1 through an abutment 18 and can thereby be disposed within the space formed by the support tubes and the cross brace 4. The connecting lever 17' can be installed to protrude over track section **9*a* so as to be acutated by a trolley moving in the axial direction of support tube section 2. The connecting rod 14 can be tensioned by the tension spring 16' against the support tube section 1 so that the switch can be switched automatically from the switch position indicated in FIG. 3** by broken lines to the switch position indicated by solid lines. In this manner, the switch can be operated automatically when a trolley enters the switch from the axial direction of the support tube 2.

Figure 4:
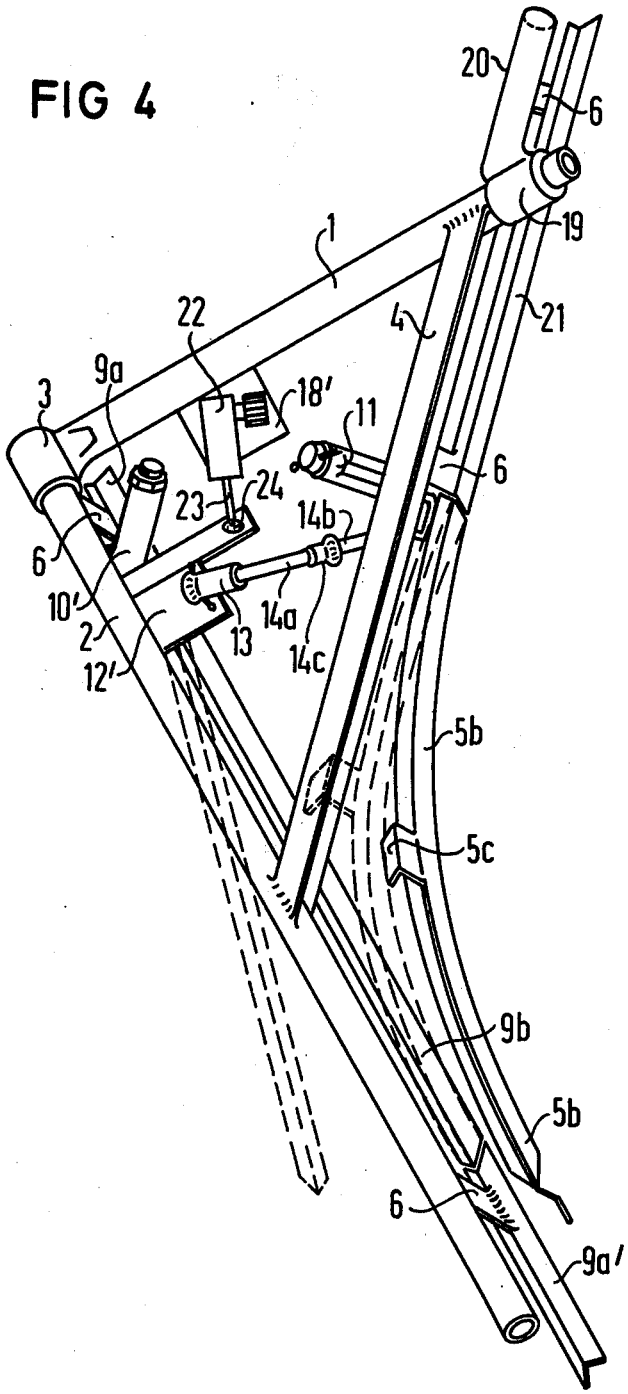
FIG. 4 is a perspective view showing a 45° switch according to the invention.

In the 90° switch shown in FIG. 3, the curved movable track section 5b corresponds to ⅛th of a circular arc. This enables use of switch having the construction as in FIG. 3 for a 45° switch with only minor changes, as shown in FIG. 4. The support tube 1 is shortened, extending slightly beyond the attachment thereto of the cross brace 4. A further support tube 20 is connected to the free end of the shortened support tube 1 by means of a connecting tube 19 and extends parallel to the axial direction of the cross brace 4. A short stationary straight track section 21 is installed in place of the curved stationary track section 5a of FIG. 3.

An angular extension 5c is provided approximately in the middle of the curved movable track section 5b to brace it against the cross brace 4 in the switched position shown in broken lines. In this manner, the curved movable track section 5b is stabilized in the switched position of the switch.

If desired, the switch according to the invention can be controlled remotely. Referring to the 45° switch of FIG. 4 for purposes of illustration, it is provided with a drive which makes it possible to control the switch and switch it remotely. The drive 22 is fastened to the support tube 1 on the mounting plate 18' which acts as an abutment. The drive includes a setting rod 23 ending in a ball joint head 24 and operates the switch by engagement of the free end of the lever plate 12' with the ball joint head 24. In order to enable fine adjustment, two connecting rod sections 14a and 14b (instead of the single connecting rod of FIG. 3) are joined together by a threaded bushing 14c so that the overall length of the two rod sections can be adjustable.

Figure 5:
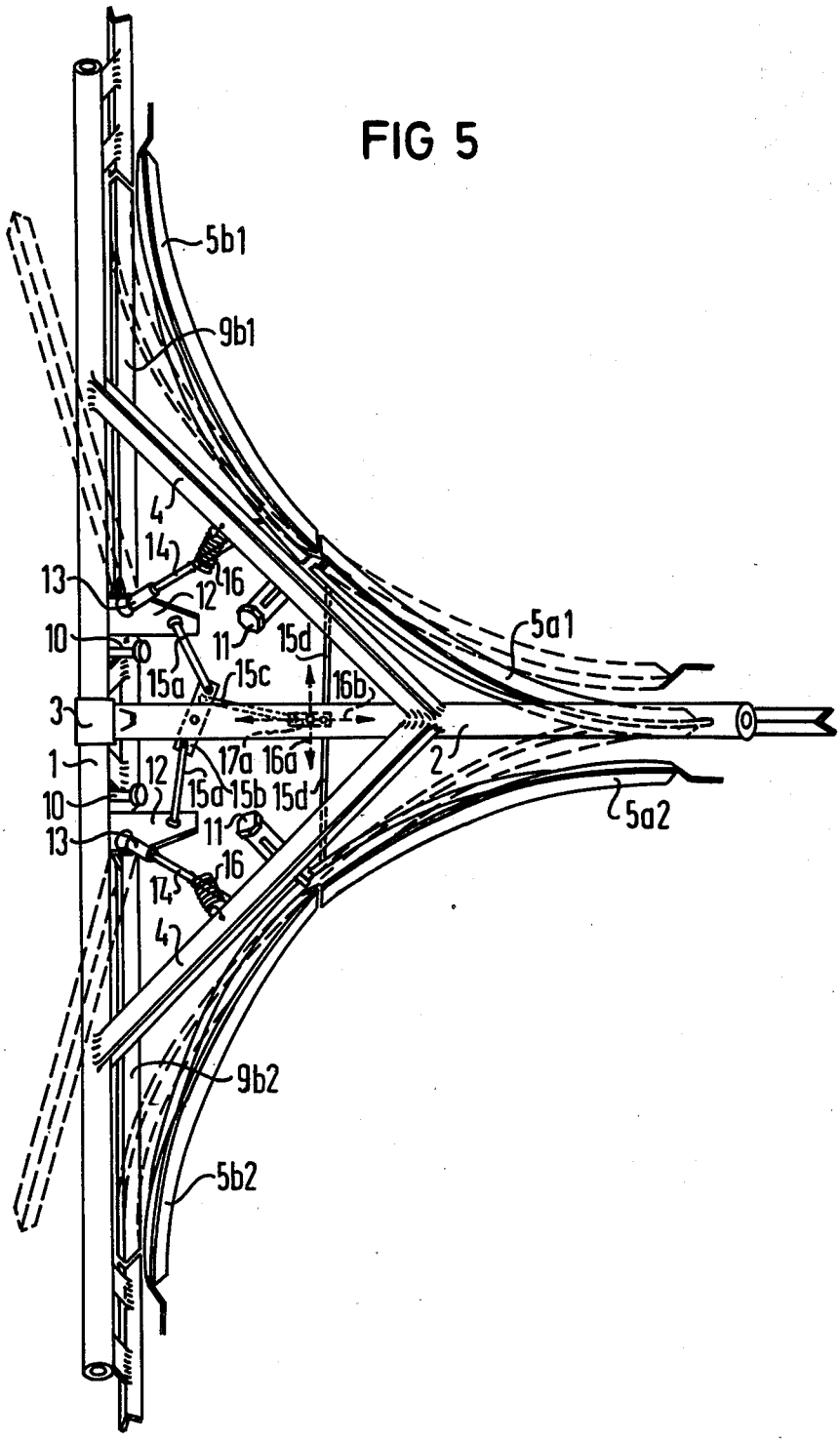
FIG. 5 is a perspective view showing a composite three-way 90° switch according to the invention.

Referring now to FIG. 5, a composite 90° three-way switch is shown which makes it possible to change, regardless of the direction of travel of a trolley along a straight line, which is stationary in FIG. 3, being movable. Curved track sections 5a (5a1 and 5a2) in FIG. 5 are movably held in pivot bearings 11 in the same manner as curved track section 5b. The middle support tube 2 is common to both switches. In FIG. 5, the four movable curved track sections are designated 5a1, 5b1 for one 90° switch and 5a2 for another 90° switch; and the straight movable track sections are designated 9b1 and 9b2.

For respective joint operation of the movable track sections 5b1/9b1 and 5b2/9b2, one end of each of lever rod 15a is secured to a respective lever plate 12 and the other end of each lever rod 15a is connected to an opposed free end of a joint plate 15b which is rotatably fastened at its center to the common support tube 2. The joint plate 15b is further connected via the control lever 15c to the switching lever mechanism 17a, which can be operated by hand. The control levers 15d of the switching mechanism 17a engage movable track sections 5b1/9b1 and 5b2/9b2 in the vicinity of the pivot bearings 11 for the joint operation of the curved movable track sections 5a1 and 5a2.

The switching lever mechanism fastened to the underside of the support tube 2 controls the movable track sections 5a1 and 5a2 in accordance with the motion of the switching lever in the direction of the arrows 16a, and the movable track sections 5b1/9b1 and 5b2/9b2 in the direction of the arrows 16b.

The advantages of the present invention, as well as certain changes and modifications of the disclosed embodiments thereof, will be readily apparent to those skilled in the art. It is the applicant's intention to cover by his claims all those changes and modifications which could be made to the embodiments of the invention herein chosen for the purpose of the disclosure without departing from the spirit and scope of the invention.

What is claimed is:

1. A switch for a suspended track transport apparatus which includes tracks for receiving the rollers of trollies and wherein said tracks are fastened by spacer elements to supports, said switch comprising a support structure which includes two support tubes connected together at an angle with each other and a cross brace connected between the two support tubes, at least one fixed track section supported by each of the support tubes at a vertical distance as small as possible, at least one curved movable track section and at least one straight movable track section, a dead space enclosed by sides extending along said two support tubes and said cross brace and having a height which does not exceed the vertical distance from the support tubes to respective fixed track sections supported by respective support tubes, first pivot means located at a first pin at point disposed entirely within said dead space and connected to said straight movable track section for movably supporting the movable straight track section, second pivot means located at a second pivot point disposed entirely within said dead space and connected to said movable curved track section for movably supporting said movable curved track section, lever means disposed entirely within said dead space coupled to said straight movable track section and said curved movable track section and cooperating with said first pivot means and said second pivot means for moving the movable track sections from one switch position in which the trollies may proceed along one path between fixed track sections and another switch position in which the trollies may proceed along another path between fixed track section, and wherein the lever means and the first and second pivot means are disposed so that the lever means engages the movable track sections in the immediate vicinity of the first and second pivot points.

2. The switch according to claim 1, wherein the first and second pivot means provide for pivoting of the movable track section about two axes in moving the movable track sections from one switch position to the other.

3. The switch according to claim 2, wherein the first and second pivot means provide for pivoting about two axes each of which extends transversely through a respective movable track section.

4. The switch according to claim 1 or 2, wherein a said second pivot means which provides for movement of the curved movable track section is mounted to the cross brace.

5. The switch according to claim 1 or 2, wherein the arc length of the curved movable track section and the length of the straight movable track section are chosen only slightly larger than the distance between adjacent trollies when they are coupled into a train.

6. The switch according to claim 1 or 2, wherein the two support tubes are connected together to form a right angle with each other and the arc length of the curved movable track section corresponds to ⅛th of a circular arc.

7. The switch according to claim 1 or 2 and including spring means for tensioning the lever means against the support structure to urge the switch into a normal switch position.

8. The switch according to claim 7 and including means for adjusting the point of engagement of the spring means with the lever means.

9. The switch according to claim 1 or 2, wherein the lever means includes a connecting rod coupling the two movable track sections together, one end of the connecting rod being fastened to one track section by a ball joint head and the other end being connected to the other track section.

10. The switch according to claim 1 or 2, wherein the lever means includes means coupled thereto adapted to be engaged by a trolley for causing the switch to change positions automatically.

11. The switch according to claim 1 or 2, wherein the two support tubes of the support structure are connected together to form a 45° angle with each other and the arc length of the curved movable track section corresponds to $\frac{1}{8}$th of a circular arc.

12. The switch according to claim 1 or 2 and including a support structure which includes a third support tube and a second cross brace, the three support tubes being connected together so that at least one of the support tubes forms an angle with the other two, a middle of the support tubes being disposed between the other two and the second cross brace being connected between the middle and third support tubes, another said switch being disposed in an additional dead space enclosed by sides extending along said middle and third support tubes and said second cross brace and having a height which does not exceed the vertical distance from the middle and third support tubes to respective fixed track sections supported by the middle and third support tubes.

13. The switch according to claim 12 and including means for interconnecting the lever means of the two switches for operating the two switches together.

14. The switch according to claim 12 wherein the three support tubes are connected to form a T structure with the middle support tube forming a 90° angle with each of the other support tubes, thereby providing two adjacent 90° switches.

* * * * *

UNITED STATES PATENT AND TRADEMARK OFFICE

CERTIFICATE OF CORRECTION

PATENT NO. : 4,457,235

DATED : July 3, 1984

INVENTOR(S) : Franz Fottner

It is certified that error appears in the above-identified patent and that said Letters Patent is hereby corrected as shown below:

Col. 5, line 41, after "line," insert --the direction of travel of the trolley by 90°. The 90° three-way switch comprises a symmetrical arrangement of mirror images of two 90° switches of the type shown in Fig. 3, with the curved track section 5a,--.

Signed and Sealed this

*Second* Day of *April 1985*

[SEAL]

*Attest:*

DONALD J. QUIGG

*Attesting Officer* *Acting Commissioner of Patents and Trademarks*